US009771537B2

(12) United States Patent
Souza et al.

(10) Patent No.: US 9,771,537 B2
(45) Date of Patent: Sep. 26, 2017

(54) MULITIGRADE ENGINE OIL WITH IMPROVED MINI-ROTARY VISCOMETER RESULTS AND PROCESS FOR PREPARING THE SAME

(71) Applicant: Chevron U.S.A. Inc., San Ramon, CA (US)

(72) Inventors: Alex Beringuy Souza, Rio de Janeiro (BR); Gerson Vieira Baeta Neves, Rio de Janeiro (BR); Luiz Fernando Feijo Lemos, Rio de Janeiro (BR); Wanderley Carreira Souza, Jr., Rio de Janeiro (BR); Matthew Hussain Ansari, San Ramon, CA (US); Rebecca Elizabeth Brafman, Concord, CA (US)

(73) Assignee: Chevron U.S.A. Inc., San Ramon, CA (US)

( * ) Notice: Subject to any disclaimer, the term of this patent is extended or adjusted under 35 U.S.C. 154(b) by 0 days.

(21) Appl. No.: 15/019,669

(22) Filed: Feb. 9, 2016

(65) Prior Publication Data

US 2016/0160145 A1 Jun. 9, 2016

Related U.S. Application Data

(63) Continuation-in-part of application No. 13/837,845, filed on Mar. 15, 2013, now Pat. No. 9,290,713, and a continuation-in-part of application No. 13/838,093, filed on Mar. 15, 2013, now Pat. No. 9,376,642.

(51) Int. Cl.

| | |
|---|---|
| ***C10M 169/04*** | (2006.01) |
| ***C10M 101/02*** | (2006.01) |
| ***C10M 171/02*** | (2006.01) |

(52) U.S. Cl.

CPC ..... *C10M 101/02* (2013.01); *C10M 169/04* (2013.01); *C10M 171/02* (2013.01); *C10M 2203/1006* (2013.01); *C10M 2203/1025* (2013.01); *C10M 2203/1065* (2013.01); *C10N 2220/022* (2013.01); *C10N 2230/02* (2013.01); *C10N 2240/10* (2013.01)

(58) Field of Classification Search

CPC C10M 101/00; C10M 101/02; C10M 169/04; C10M 171/02; C10M 2203/1065; C10M 2203/1006; C10M 2203/1025; C10N 2220/022; C10N 2240/10; C10N 2230/02

See application file for complete search history.

(56) References Cited

U.S. PATENT DOCUMENTS

| | | | | |
|---|---|---|---|---|
| 7,520,976 | B2 | 4/2009 | Miller et al. | |
| 7,875,458 | B2 | 1/2011 | Eagan et al. | |
| 7,926,453 | B2 | 4/2011 | Roby et al. | |
| 7,956,018 | B2 | 6/2011 | McGeehan | |
| 7,991,104 | B1 | 8/2011 | Dahan | |
| 2008/0015400 | A1* | 1/2008 | Matsui | C10M 101/00 585/1 |
| 2009/0143261 | A1* | 6/2009 | Takeoka | C10M 107/02 508/110 |
| 2010/0077842 | A1 | 4/2010 | Rosenbaum et al. | |
| 2011/0183879 | A1* | 7/2011 | Kolb | C08F 210/16 508/591 |
| 2012/0132166 | A1 | 5/2012 | Andoh et al. | |
| 2014/0274828 | A1 | 9/2014 | Souza et al. | |
| 2014/0274829 | A1 | 9/2014 | Souza et al. | |

OTHER PUBLICATIONS

Hipeaux, J.C. et al., "Physico-chemical characterization of base stocks and thermal analysis by differential scanning calorimetry and thermomicroscopy at low temperature", Thermochimica Acta, 2000, vol. 348, pp. 147-159.

Chevron Lubricants Group II/II+ Product Specification Sheet http://www.chevronbaseoils.com/en_US/products.html#Vb-f43rD-Uk.

* cited by examiner

*Primary Examiner* — Taiwo Oladapo

(74) *Attorney, Agent, or Firm* — Melissa M. Hayworth; E. Joseph Gess; Susan M. Abernathy

(57) ABSTRACT

Disclosed herein is a multigrade engine oil with excellent low temperature viscometric properties, including improved mini-rotary viscometer (MRV) results. In one embodiment, the multigrade engine oil comprises a major amount of a first lubricating base oil having a MRV viscosity at a test temperature from about −25° C. to about −40° C. of greater than 60,000 cP and a MRV yield stress at the test temperature of greater than zero; a second lubricating base oil having a MRV viscosity at the test temperature of 60,000 cP of less and no MRV yield stress at the test temperature; and a pour point depressant. The multigrade engine oil has a MRV viscosity at the test temperature of 60,000 cP or less and no MRV yield stress at the test temperature. Since the first lubricating base oil is present in a major amount, the first lubricating base oil is present in an amount greater than any other component of the multigrade engine oil, including the amount of the second lubricating base oil. Also disclosed herein is a process for preparing a multigrade engine oil with excellent low temperature viscometric properties, including improved MRV results.

15 Claims, No Drawings

MULITIGRADE ENGINE OIL WITH IMPROVED MINI-ROTARY VISCOMETER RESULTS AND PROCESS FOR PREPARING THE SAME

RELATED APPLICATIONS

The present application is a continuation-in-part of U.S. application Ser. No. 13/837,845, entitled "Base Oil Blend Upgrading Process with a Group II Base Oil Yield Improved Mini-Rotary Viscometer Results" filed on 15 Mar. 2013, and U.S. application Ser. No. 13/838,093, entitled "Multi-Grade Engine Oil Formulations With Improved Mini-Rotary Viscometer Results" filed on 15 Mar. 2013, the entire contents of both of which are herein incorporated by reference in their entireties.

FIELD OF THE INVENTION

Disclosed herein are a multigrade engine oil with excellent low temperature viscometric properties, including improved mini-rotary viscometer (MRV) results and a process for preparing a multigrade engine oil with excellent low temperature properties, including improved mini-rotary viscometer (MRV) results.

BACKGROUND OF THE INVENTION

Engine oils are finished crankcase lubricants intended for use in automobile engines and diesel engines and generally consist of a lubricating base oil and additives. Lubricating base oil is the major constituent in these finished lubricants and contributes significantly to the properties of the engine oil. In general, a few lubricating base oils are used to manufacture a variety of engine oils by varying the mixtures of individual lubricating base oils and individual additives.

The dewaxing processes used to manufacture lubricating oil basestocks can result in breakdowns or inefficiencies in the processes affording a quantity of wax beyond an acceptable basestock manufacture specification. The presence of contamination wax or excessive wax content can occur as a result of leakage of wax through rips or tears in the wax filter cloth used in solvent dewaxing processes, overloading of the solvent dewaxing processes, basestock channeling through the catalytic beds used in catalytic dewaxing processes, over-loading of the catalytic dewaxing process, poor catalyst activity or selectivity or because the crude oil or feedstock to the process is significantly different than expected, resulting in unsuitable dewaxing process conditions.

Lubricating oil basestocks containing undesirable quantities of contamination wax or excessive wax can result in growth of wax crystals, which is typically a slow process. The growth may only become visible upon visual inspection after several days or weeks. As a consequence, when fully formulated oils are produced using basestocks containing unidentified undesirable wax contamination, an entire batch of product may fail to function properly at low temperature.

In particular, the formulated oil may exhibit unsatisfactory low temperature viscometric properties. Indeed, formulated lube oils have been found to fail key low temperature viscometric properties for the oil [e.g., the cold cranking simulator (CCS) viscosity or the mini-rotary viscometer (MRV)], despite passing the specification established for the oil with respect to cloud point and/or pour point.

Contamination wax or excessive wax can result in a highly non-Newtonian increase in low temperature viscometrics in fully formulated oils resulting in high viscosities and/or poor pumpability at low temperatures. With regard to engine oils, hydraulic oils or transmission fluids, the increase in low temperature viscometrics or the reduction in or loss of filterability results in a failure of the oil to properly lubricate key components. Moreover, wax crystals can form a haze in the oil upon standing, which is undesirable for customers from a cosmetic perspective, as well.

The Society of Automotive Engineers (SAE) J300 standards provide the minimum specifications for the various viscosity grades of engine oils in the United States. The SAE J300 standards include MRV viscosity specifications. Due to the problems associated with contamination wax or excessive wax, there is a need for engine oils meeting low temperature viscometric properties including MRV viscosity specifications under the SAE J300 standards.

SUMMARY OF THE INVENTION

Disclosed herein is a multigrade engine oil with excellent low temperature viscometric properties, including improved mini-rotary viscometer (MRV) results. In one embodiment, the multigrade engine oil comprises a major amount of a first lubricating base oil having a MRV viscosity at a test temperature from about −25° C. to about −40° C. of greater than 60,000 cP and a MRV yield stress at the test temperature of greater than zero; a second lubricating base oil having a MRV viscosity at the test temperature of 60,000 cP of less and no MRV yield stress at the test temperature; and a pour point depressant. The multigrade engine oil has a MRV viscosity at the test temperature of 60,000 cP or less and no MRV yield stress at the test temperature.

Also disclosed herein is a process for preparing a multigrade engine oil. In one embodiment, the process comprises providing in a major amount a first lubricating base oil having a MRV viscosity at a test temperature from about −25° C. to about −40° C. of greater than 60,000 cP and a MRV yield stress at the test temperature of greater than zero; providing a second lubricating base oil having a MRV viscosity at the test temperature of 60,000 cP or less and no MRV yield stress at the test temperature; providing a pour point depressant; and blending the first lubricating base oil, the second lubricating base oil, and the pour point depressant to provide the multigrade engine oil. According to this embodiment, the multigrade engine oil has a MRV viscosity at the test temperature of 60,000 cP or less and no MRV yield stress at the test temperature.

DETAILED DESCRIPTION OF THE INVENTION

As described herein, the multigrade engine oil comprises a first lubricating base oil in a major amount, wherein the first lubricating base oil has a MRV viscosity at a test temperature of from about −25° C. to about −40° C. of greater than 60,000 cP and a MRV yield stress at the test temperature of greater than zero. Even with this major amount of the first lubricating base oil, the multigrade engine oil exhibits excellent low temperature viscometric properties, including improved mini-rotary viscometer (MRV) results.

In the United States, the SAE has established a system for engine oil classification based on viscosity: J300. Multigrade engine oils meet the requirements of more than one SAE grade. Multigrade engine oils are preferred over monograde engine oils because they are suitable for use over a wider temperature range than a monograde oil. In particular, multigrade engine oils meet both a low-temperature viscosity specification and a high-temperature viscosity specification. For example, for a multigrade engine oil classified as 10W-40, 10W refers to the low-temperature grade and 40 refers to the high-temperature grade.

SAE J300 specifies the maximum MRV viscosity for the various SAE low-temperature viscosity grades:

SAE J300 Viscosity Classification

| SAE Viscosity Grade | Maximum MRV viscosity (cP) at temperature (° C.) |
|---|---|
| 0 W | 60,000 at −40 |
| 5 W | 60,000 at −35 |
| 10 W | 60,000 at −30 |
| 15 W | 60,000 at −25 |
| 20 W | 60,000 at −20 |
| 25 W | 60,000 at −15 |

As shown in the table above, the SAE viscosity grade is associated with a particular test temperature and a maximum MRV viscosity at the particular test temperature. For example, SAE viscosity grade 0W is associated with a test temperature of −40° C. and a maximum MRV viscosity of 60,000 cP at the test temperature of −40° C.

The Standard Test Method for Determination of Yield Stress and Apparent Viscosity of Engine Oils at Low Temperature (ASTM D4684) measures MRV viscosity and yield stress. Rate and duration of cooling of engine oil can affect its yield stress and viscosity. ASTM D4684 cools an engine oil slowly through a temperature range where wax crystallization is known to occur and then rapidly cools the engine oil to a final test temperature. ASTM D4684 determines oil pumpability. Failure of the MRV test is believed to be the result of the oil forming a gel structure that results in either excessive yield stress or viscosity of the engine oil or both.

A pour point depressant additive can be added to a lubricating base oil having a MRV viscosity failing SAE J300 MRV specification in an attempt to reduce the MRV viscosity to the required maximum. However, there are practical limits to the amount of pour point depressant that is appropriate to add because pour point depressant additives are relatively expensive and addition of too much pour point depressant can degrade other properties. As such, for certain lubricating base oils, a passing MRV viscosity cannot be achieved with addition of pour point depressant. These "low quality" lubricating base oils have been considered unsuitable for formulating multigrade engine oils.

This failure of "low quality" lubricating base oils to achieve SAE J300 MRV specification is demonstrated in the Examples. As demonstrated in the Examples herein, adding pour point depressant to lubricating base oils failing SAE J300 MRV specification is not sufficient to lower the MRV viscosity to 60,000 cP or less and does not eliminate the MRV yield stress, even as the amount of pour point depressant is increased. Thus, these lubricating base oils cannot be formulated to meet SAE J300 MRV specification and these lubricating base oils failing SAE J300 MRV specification traditionally have not been used to prepare multigrade engine oils.

It has been surprisingly discovered that blending a major amount of a first lubricating base oil failing SAE J300 MRV specification (i.e., having a MRV viscosity at a test temperature from about −25° C. to about −40° C. of greater than 60,000 cP and a MRV yield stress at the test temperature of greater than zero) with a smaller amount of a second lubricating base oil meeting SAE J300 MRV specification (i.e., having a MRV viscosity at the test temperature of 60,000 cP or less and no MRV yield stress at the test temperature) and a pour point depressant can advantageously provide a multigrade engine oil meeting SAE J300 MRV specification (i.e., having a MRV viscosity at the test temperature of 60,000 cP or less and no MRV yield stress at the test temperature). It is unexpected and surprising that blending a major amount of a first lubricating base oil failing SAE J300 MRV specification with a smaller amount of a second lubricating base oil meeting SAE J300 MRV specification and a pour point depressant can provide a multigrade engine oil meeting SAE J300 MRV specification. Furthermore, while some amount of pour point depressant is present in the multigrade engine oil, only a small amount of pour point depressant is sufficient.

As set forth above, the SAE J300 specifies the maximum MRV viscosity at various low temperatures. The test temperatures are from about −15° C. to about −40° C. Depending on the SAE viscosity grade desired, the test temperatures are −15° C., −20° C., −25° C., −30° C., −35° C., or −40° C. In one embodiment, the test temperature is from about −15° C. to about −40° C. In one embodiment, the test temperature is from about −25° C. to about −40° C. In another embodiment, the test temperature is at about −30° C.

DEFINITIONS

The following terms are used throughout the specification and claims and have the following meanings unless otherwise indicated.

"Group I base oil" or "Group I" refers to a base oil that contains less than 90% saturates and/or greater than 0.03% sulfur and has a viscosity index greater than or equal to 80 and less than 120 using the test methods specified in Table E-1 of American Petroleum Institute Publication 1509, which is reproduced below:

TABLE E-1

Analytical Methods for Base Stock

| Property | Test Method |
|---|---|
| Saturates | ASTM D2007 |
| Viscosity index | ASTM D2270 |
| Sulfur (use one listed method) | ASTM D1552 |
| | ASTM D2622 |
| | ASTM D3120 |
| | ASTM D4294 |
| | ASTM D4927 |

"Group II base oil" or "Group II" refers to a base oil that contains greater than or equal to 90% saturates and less than or equal to 0.03% sulfur and has a viscosity index greater than or equal to 80 and less than 120 using the test methods specified in Table E-1 of American Petroleum Institute Publication 1509.

In a "major amount" means that component is present in an amount greater than any other component of the multigrade engine oil based on weight percentage. In some embodiments, a major amount will refer to an amount of 40 wt % or 50 wt % or greater (e.g., 60 wt %, 70 wt %, or 80 wt %) based on the total weight of the multigrade engine oil.

In a "minor amount" means that component is present in an amount of less than 50 wt % (e.g., 40 wt %, 30 wt %, or 20 wt %) based on the total weight of the multigrade engine oil.

"No MRV yield stress" means a yield stress value of zero as measured using ASTM D4684 at the indicated test temperature.

Unless otherwise required by context, singular terms shall include pluralities and plural terms shall include the singular. More specifically, the singular forms "a", "an" and "the" include plural referents unless the context clearly dictates otherwise. Thus, for example, reference to "a first base oil" includes one or a plurality of base oils meeting the definition of a first base oil and reference to "a pour point depressant" includes one or a plurality of pour point depressants. However, when referencing test temperature, "a test temperature" from about −25° C. to about −40° C. refers to a single test temperature within the temperature range.

Ranges include both end points and all points between the end points. Therefore, for example, a range of from 0.1 to 2 includes 0.1, 2, and all points between 0.1 and 2.

SAE Viscosity Grades

According to one embodiment, a multigrade engine oil comprises a first lubricating base oil having a MRV viscosity at −30° C. of greater than 60,000 cP and a MRV yield stress at −30° C. of greater than zero in a major amount; a second base oil having a MRV viscosity at −30° C. of 60,000 cP or less and no MRV yield stress at −30° C.; and a pour point depressant. Since the first lubricating base oil is present in a major amount, the first lubricating base oil is present in an amount greater than any other component of the multigrade engine oil, including the amount of the second lubricating base oil. The multigrade engine oil comprising the first lubricating base oil, second lubricating base oil, and pour point depressant has a MRV viscosity at −30° C. of 60,000 cP or less and no MRV yield stress at −30° C. In this embodiment, the multigrade engine oil meets SAE viscosity grade 10W. 10W refers to the low-temperature grade. The multigrade engine oil can be a SAE viscosity grade 10W-X engine oil, where X represents the integer 20, 30, or 40 with X representing the high-temperature grade. In one embodiment, the multigrade engine is a SAE viscosity grade 10W-30 engine oil.

In one embodiment, the multigrade engine oil has a MRV viscosity at about −30° C. of 50,000 cP or less.

According to another embodiment, a multigrade engine oil comprises a first lubricating base oil having a MRV viscosity at −40° C. of greater than 60,000 cP and a MRV yield stress at −40° C. of greater than zero in a major amount; a second lubricating base oil having a MRV viscosity at −40° C. of 60,000 cP or less and no MRV yield stress at −40° C.; and a pour point depressant. Since the first lubricating base oil is present in a major amount, the first lubricating base oil is present in an amount greater than any other component of the multigrade engine oil, including the amount of the second lubricating base oil. The multigrade engine oil has a MRV viscosity at −40° C. of 60,000 cP or less and no MRV yield stress at −40° C. In this embodiment, the multigrade engine oil meets SAE viscosity grade 0W, with 0W referring to the low-temperature grade. The multigrade engine oil can be a SAE viscosity grade 0W-X engine oil, where X represents an integer selected from the group consisting of 20, 30, and 40 with X representing the high-temperature grade.

According to yet another embodiment, a multigrade engine oil comprises a first lubricating base oil having a MRV viscosity at about −35° C. of greater than 60,000 cP and a MRV yield stress at about −35° C. of greater than zero in a major amount; a second lubricating base oil having a MRV viscosity at about −35° C. of 60,000 cP or less and no MRV yield stress at about −35° C.; and a pour point depressant. The multigrade engine oil has a MRV viscosity at about −35° C. of 60,000 cP or less and no MRV yield stress at about −35° C. Since the first lubricating base oil is present in a major amount, the first lubricating base oil is present in an amount greater than any other component of the multigrade engine oil, including the amount of the second lubricating base oil. In this embodiment, the multigrade engine oil meets SAE viscosity grade 5W, with 5W referring to the low-temperature grade. The multigrade engine oil can be a SAE viscosity grade 5W-X engine oil, where X represents the integer 20, 30, or 40 with X representing the high-temperature grade.

According to an alternative embodiment, a multigrade engine oil comprises a first lubricating base oil having a MRV viscosity at about −25° C. of greater than 60,000 cP and a MRV yield stress at about −25° C. of greater than zero in a major amount; a second lubricating base oil having a MRV viscosity at about −25° C. of 60,000 cP or less and no MRV yield stress at about −25° C.; and a pour point depressant. The multigrade engine oil has a MRV viscosity at about −25° C. of 60,000 cP or less and no MRV yield stress at about −25° C. Since the first lubricating base oil is present in a major amount, the first lubricating base oil is present in an amount greater than any other component of the multigrade engine oil, including the amount of the second lubricating base oil. In this embodiment, the multigrade engine oil meets SAE viscosity grade 15W with 15W referring to the low-temperature grade. The multigrade engine oil can be a SAE viscosity grade 15W-X engine oil, where X represents the integer 20, 30, or 40 with X representing the high-temperature grade.

Components

The multigrade engine oil comprises a first lubricating base oil in a major amount, a second lubricating base oil, and a pour point depressant. In one embodiment, the multigrade engine oil comprises the pour point depressant in an amount of from about 0.1 wt % to about 2 wt %. In another embodiment, the multigrade engine oil comprises the pour point depressant in an amount of from about 0.1 wt % to about 1 wt %. Alternatively, the multigrade engine oil comprises the pour point depressant in an amount of from about 0.1 wt % to about 0.5 wt %. The multigrade engine oil can also include one or more base oil additives in addition to the pour point depressant.

The multigrade engine oil includes the first lubricating base oil in a major amount. Since the first lubricating base oil is present in a major amount, the first lubricating base oil is present in an amount greater than any other component of the multigrade engine oil, including the amount of the second lubricating base oil.

In certain embodiments, the multigrade engine oil can comprise the first lubricating base oil in a major amount of the first lubricating base oil, the second lubricating base oil in a minor amount, and the pour point depressant in an amount of from about 0.1 wt % to about 2 wt %. It is advantageous that the multigrade engine oil can include a major amount of the first lubricating base oil and a minor amount of the second lubricating base oil.

In certain embodiments, the first base oil can be a Group I base oil. The second base oil can be a Group II base oil.

In one embodiment, the multigrade engine oil can include the first lubricating base oil in an amount of from about 40 wt % to about 95 wt % and the second lubricating base oil in an amount of from about 5 wt % to about 35 wt % of the second base oil. Alternatively, the multigrade engine oil can include the first lubricating base oil in an amount of from about 40 wt % to about 90 wt % and the second lubricating base oil in an amount of from about 5 wt % to about 35 wt %. In these embodiments, the multigrade engine oil can include the pour point depressant in an amount of from about 0.1 wt % to about 2 wt %. In certain of these embodiments, the multigrade engine oil can include the pour point depressant in an amount of from about 0.1 wt % to about 0.5 wt %.

In other embodiments, the multigrade engine oil can include the first lubricating base oil in an amount of from about 40 wt % to about 80 wt % and the second lubricating base oil in an amount of from about 10 wt % to about 40 wt %. In other embodiments, the multigrade engine oil can include the first lubricating base oil in an amount of from about 40 wt % to about 80 wt % and the second lubricating base oil in an amount of from about 10 wt % to about 30 wt %. In this embodiment, the multigrade engine oil can include the pour point depressant in an amount of from about 0.1 wt % to about 2 wt % or in an amount of from about 0.1 wt % to about 1.0 wt %. The multigrade engine oil can also include one or more base oil additives in addition to the pour point depressant.

As another example, the multigrade engine oil can include the first lubricating base oil in an amount of from about 50 wt % to about 70 wt % and the second lubricating base oil in an amount of from about 15 wt % to about 25 wt %. As another example, the multigrade engine oil can include the first lubricating base oil in an amount of from about 55 wt % to about 65 wt % and the second lubricating base oil in an amount of from about 15 wt % to about 25 wt %.

In one embodiment, the first base oil and the second base oil combined are greater than about 70 wt % of the multigrade engine oil, for example, greater than about 75 wt %, greater than about 80 wt %, greater than about 85 wt %, greater than about 90 wt %, or greater than about 95 wt %.

Additives

As described herein, the multigrade engine oil comprises a pour point depressant. Pour point depressants are well known to those of ordinary skill in the art. Pour point depressants are additives that improve low-temperature fluidity of lubricants by countering the negative effects of wax-like formations which inhibit free oil flow. Examples of suitable pour point depressants include pour point depressant products manufactured by Evonik Industries, such as Viscoplex 1-425 and Viscoplex 1-604, pour point depressant products manufactured by Lubrizol, such as Lubrizol 7418B, and pour point depressant products manufactured Infineum, such as V385.

In one embodiment, the multigrade engine oil comprises the pour point depressant in an amount of from about 0.1 wt % to about 2 wt %. In another embodiment, the multigrade engine oil comprises the pour point depressant in an amount of from about 0.1 wt % to about 1 wt %. Alternatively, the multigrade engine oil comprises the pour point depressant in an amount of from about 0.1 wt % to about 0.5 wt %. In one specific embodiment, the multigrade engine oil comprises the pour point depressant in an amount of about 0.3 wt %.

The multigrade engine oil can also include one or more base oil additives in addition to the pour point depressant. These additional base oil additives are also well known to those of ordinary skill in the art. For example, other base oil additives include anti-wear additives, extreme pressure agents, detergents (e.g., metal-containing detergents), dispersants (e.g., ashless dispersants), antioxidants, viscosity index improvers, viscosity modifiers, friction modifiers, demulsifiers, antifoaming agents, inhibitors (e.g., corrosion inhibitors), seal swell agents, emulsifiers, wetting agents, lubricity improvers, metal deactivators, gelling agents, tackiness agents, bactericides, fluid-loss additives, colorants, and the like. Additives can be added in the form of an additive package, containing various additives. Certain classes of other base oil additives are discussed below. Base oil additives, including their function, selection, and appropriate amounts, are well known to those of ordinary skill in the art.

Certain additives are multifunctional. For example, a single additive may act as a dispersant as well as an antioxidant.

The multigrade engine oil can include from about 0.5 wt % to about 30 wt % of the pour point depressant and the one or more other base oil additives. The multigrade engine oil can include from about 0.4 wt % to about 30 wt % of the one or more base oil additives in addition to the pour point depressant.

In certain embodiments, the multigrade engine oil can include a dispersant in addition to the pour point depressant. Dispersants are generally used to maintain in suspension insoluble materials resulting from oxidation during use, thus preventing sludge flocculation and precipitation or deposition on engine parts.

Examples of dispersants include nitrogen-containing ashless (metal-free) dispersants. An ashless dispersant generally comprises an oil soluble polymeric hydrocarbon backbone having functional groups that are capable of associating with particles to be dispersed.

An ashless dispersant may be selected from oil soluble salts, esters, amino-esters, amides, imides, and oxazolines of long chain hydrocarbon substituted mono and dicarboxylic acids or their anhydrides; thiocarboxylate derivatives of long chain hydrocarbons, long chain aliphatic hydrocarbons having a polyamine attached directly thereto; and Mannich condensation products formed by condensing a long chain substituted phenol with formaldehyde and polyalkylene polyamine. Carboxylic dispersants are reaction products of carboxylic acylating agents (acids, anhydrides, esters, etc.) comprising at least 34 and preferably at least 54 carbon atoms with nitrogen containing compounds (such as amines), organic hydroxy compounds (such as aliphatic compounds including monohydric and polyhydric alcohols, or aromatic compounds including phenols and naphthols), and/or basic inorganic materials. These reaction products include imides, amides, and esters, e.g., succinimide dispersants.

Other suitable ashless dispersants may also include amine dispersants, which are reaction products of relatively high molecular weight aliphatic halides and amines, preferably polyalkylene polyamines. Other examples include "Mannich dispersants," which are reaction products of alkyl phenols in which the alkyl group contains at least 30 carbon atoms with aldehydes (especially formaldehyde) and amines (especially polyalkylene polyamines). Furthermore, ashless dispersants may even include post-treated dispersants, which are obtained by reacting carboxylic, amine or Mannich dispersants with reagents such as dimercaptothiazoles, urea, thiourea, carbon disulfide, aldehydes, ketones, carboxylic acids, hydrocarbon-substituted succinic anhydrides, nitrile epoxides, boron compounds and the like. Suitable ashless dispersants may be polymeric, which are interpolymers of oil-solubilizing monomers such as decyl methacrylate, vinyl decyl ether and high molecular weight olefins with monomers containing polar substitutes. Other suitable ashless dispersants may also include an ethylene carbonate-treated bissuccinimide derived from a polyisobutylene having a number average molecular weight of about 2300 Daltons ("PIBSA 2300").

Other examples of dispersants include, but are not limited to, amines, alcohols, amides, or ester polar moieties attached to the polymer backbones via bridging groups.

The multigrade engine oil can include a viscosity index improver (i.e., viscosity modifier) in addition to the pour point depressant. The viscosity index of an engine oil base stock can be increased, or improved, by incorporating therein certain polymeric materials that function as viscosity modifiers or viscosity index improvers in an amount of 0.3 to 25 wt % of the final weight of the engine oil. Examples include, but are not limited to, olefin copolymers, such as ethylene-propylene copolymers, styrene-isoprene copolymers, hydrated styrene-isoprene copolymers, polybutene, polyisobutylene, polymethacrylates, vinylpyrrolidone and methacrylate copolymers and dispersant type viscosity index improvers. These viscosity modifiers can optionally be grafted with grafting materials such as, for example, maleic anhydride, and the grafted material can be reacted with, for example, amines, amides, nitrogen-containing heterocyclic compounds or alcohol, to form multifunctional viscosity modifiers (dispersant-viscosity modifiers).

Other examples of viscosity modifiers include star polymers (e.g., a star polymer comprising isoprene/styrene/isoprene triblock). Yet other examples of viscosity modifiers include poly alkyl(meth)acrylates of low Brookfield viscosity and high shear stability, functionalized poly alkyl(meth) acrylates with dispersant properties of high Brookfield viscosity and high shear stability, polyisobutylene having a weight average molecular weight ranging from 700 to 2,500 Daltons and mixtures thereof.

The multigrade engine oil can include a friction modifier in addition to the pour point depressant. Certain sulfur-containing organo-molybdenum compounds are known to modify friction in lubricating oil compositions, while also providing antioxidant and anti-wear properties. Examples of oil soluble organo-molybdenum compounds include molybdenum succinimide complex, dithiocarbamates, dithiophosphates, dithiophosphinates, xanthates, thioxanthates, sulfides, and the like, and mixtures thereof.

Other examples include at least a mono-, di- or triester of a tertiary hydroxyl amine and a fatty acid as a friction modifying fuel economy additive. Other examples are selected from the group of succinamic acid, succinimide, and mixtures thereof. Other examples are selected from an aliphatic fatty amine, an ether amine, an alkoxylated aliphatic fatty amine, an alkoxylated ether amine, an oil-soluble aliphatic carboxylic acid, a polyol ester, a fatty acid amide, an imidazoline, a tertiary amine, a hydrocarbyl succinic anhydride or acid reacted with an ammonia or a primary amine, and mixtures thereof.

The multigrade engine oil can include a seal swell agent in addition to the pour point depressant. Seal swell agents are also known as seal fixes and seal pacifiers. They are often employed in lubricant or additive compositions to insure proper elastomer sealing, and prevent premature seal failures and leakages. Seal swell agents may be selected from oil-soluble, saturated, aliphatic, or aromatic hydrocarbon esters such as di-2-ethylhexylphthalate, mineral oils with aliphatic alcohols such as tridecyl alcohol, triphosphite ester in combination with a hydrocarbonyl-substituted phenol, and di-2-ethylhexylsebacate.

The multigrade engine oil can include a corrosion inhibitor in addition to the pour point depressant. Corrosion inhibitors are typically added to reduce the degradation of the metallic parts contained in the engine oil in amounts from about 0.02 to 1 wt %. Examples include zinc dialkyldithiophosphate, phosphosulfurized hydrocarbons and the products obtained by reaction of a phosphosulfurized hydrocarbon with an alkaline earth metal oxide or hydroxide, preferably in the presence of an alkylated phenol or of an alkylphenol thioester. The corrosion inhibitor may be a nonionic polyoxyethylene surface active agent. Nonionic polyoxyethylene surface active agents include, but are not limited to, polyoxyethylene lauryl ether, polyoxyethylene higher alcohol ether, polyoxyethylene nonylphenyl ether, polyoxyethylene octylphenyl ether, polyoxyethylene octyl stearyl ether, polyoxyethylene oleyl ether, polyoxyethylene sorbitol monostearate, polyoxyethylene sorbitol monooleate, and polyethylene glycol monooleate. Corrosion inhibitors may also be other compounds, which include, for example, stearic acid and other fatty acids, dicarboxylic acids, metal soaps, fatty acid amine salts, metal salts of heavy sulfonic acid, partial carboxylic acid ester of polyhydric alcohols, and phosphoric esters. The corrosion inhibitor may be a calcium stearate salt.

The multigrade engine oil can include a detergent in addition to the pour point depressant. In engine oil compositions, metal-containing or ash-forming detergents function both as detergents to reduce or remove deposits and as acid neutralizers or corrosion inhibitors, thereby reducing wear and corrosion and extending engine life. Detergents generally comprise a polar head with long hydrophobic tail, with the polar head comprising a metal salt of an acid organic compound.

Detergents are normally salts (e.g., overbased salts) and are single phase, homogeneous Newtonian systems characterized by a metal content in excess of that which would be present according to the stoichiometry of the metal and the particular acidic organic compound reacted with the metal. An exemplary detergent is a carboxylate detergent. Carboxylate detergents, e.g., salicylates, can be prepared by reacting an aromatic carboxylic acid with an appropriate metal compound such as an oxide or hydroxide. Examples of overbased detergents include, but are not limited to calcium sulfonates, calcium phenates, calcium salicylates, calcium stearates and mixtures thereof. Overbased detergents may be low overbased (e.g., Total Base Number (TBN) below about 50). Suitable overbased detergents may alternatively be high overbased (e.g., TBN above about 150) or medium overbased (e.g., TBN between 50 and 150). Other suitable detergents include "hybrid" detergents such as, for example, phenate/salicylates, sulfonate/phenates, sulfonate/salicylates, sulfonates/phenates/salicylates, and the like. The composition may comprise detergents made from alkyl benzene and fuming sulfonic acid, phenates (high overbased, medium overbased, or low overbased), high overbased phenate stearates, phenolates, salicylates, phosphonates, thiophosphonates, sulfonates, carboxylates, ionic surfactants and sulfonates and the like.

The multigrade engine oil can include an antioxidant in addition to the pour point depressant. Antioxidants reduce the tendency of mineral oils to deteriorate in service, which deterioration is evidenced by the products of oxidation such as sludge, lacquer, and varnish-like deposits on metal surfaces. The engine oil composition may contain from about 50 ppm to about 5.00 wt % of at least an antioxidant selected from the group of phenolic antioxidants, aminic antioxidants, or a combination thereof. The amount of antioxidants may be between 0.10 to 3.00 wt %. The amount of antioxidants may be between about 0.20 to 0.80 wt %. An example of an antioxidant used is di-C8-diphenylamine, in an amount of about 0.05 to 2.00 wt % of the total weight of the oil composition. Other examples of antioxidants include MoS and Mo oxide compounds.

Other examples of antioxidants include hindered phenols; alkaline earth metal salts of alkylphenolthioesters having $C_5$ to $C_{12}$ alkyl side chains; calcium nonylphenol sulphide; oil soluble phenates and sulfurized phenates; phosphosulfurized or sulfurized hydrocarbons or esters; phosphorous esters; metal thiocarbamates; oil soluble copper compounds known in the art; phenyl naphthyl amines such as phenylene diamine, phenothiazine, diphenyl amine, diarylamine; phenyl-alphanaphthylamine, 2,2'-diethyl-4,4'-dioctyl diphenylamine, 2,2'diethyl-4-t-octyldiphenylamine; alkaline earth metal salts of alkylphenol thioesters, having $C_5$ to $C_{12}$ alkyl side chains, e.g., calcium nonylphenol sulfide, barium t-octylphenol sulfide, zinc dialkylditbiophosphates, dioctylphenylamine, phenylalphanaphthylamine and mixtures thereof. Some of these antioxidants further function as corrosion inhibitors. Other suitable antioxidants which also function as anti-wear agents include bis alkyl dithiothiadiazoles such as 2,5-bis-octyl dithiothiadiazole.

The multigrade engine oil can include an anti-foaming agent in addition to the pour point depressant. For example, the engine oil may comprise an anti-foaming agent in amounts ranging from about 5 to about 50 ppm. Examples include alkyl methacrylate polymers, dimethyl silicone polymers, and foam inhibitors of the polysiloxane type, e.g., silicone oil and polydimethyl siloxane, for foam control. The anti-foaming agent may be a mixture of polydimethyl siloxane and fluorosilicone. Another example of an anti-foaming agent is an acrylate polymer anti-foamant, with a weight ratio of the fluorosilicone antifoamant to the acrylate antifoamant ranging from about 3:1 to about 1:4. Another example of an anti-foaming agent is an anti-foam-effective amount of a silicon-containing anti-foaming agent such that the total amount of silicon in the engine oil is at least 30 ppm. The silicon-containing antifoaming agent may be selected from the group consisting of fluorosilicones, polydimethylsiloxane, phenyl-methyl polysiloxane, linear siloxanes, cyclic siloxanes, branched siloxanes, silicone polymers and copolymers, organo-silicone copolymers, and mixtures thereof.

The multigrade engine oil can include an anti-wear additive in addition to the pour point depressant. The composition may comprise at least an anti-wear additive selected from phosphates, phosphites, carbamates, esters, sulfur containing compounds, and molybdenum complexes. Other suitable anti-wear additives are zinc dialkyldithiophosphate, zinc diaryldilhiophosphate, Zn or Mo dithiocarbamates, phosphites, amine phosphates, borated succinimide, magnesium sulfonate, and mixtures thereof. The composition may comprise at least a dihydrocarbyl dithiophosphate metal as an anti-wear additive and antioxidant in amounts of about 0.1 to about 10 wt %. The metal may be an alkali or alkaline earth metal, or aluminum, lead, tin, molybdenum, manganese, nickel or copper.

The multigrade engine oil can include an extreme pressure agent in addition to the pour point depressant. Examples include alkaline earth metal borated extreme pressure agents and alkali metal borated extreme pressure agents. Other examples include sulfurized olefins, zinc dialky-1-dithiophosphate (primary alkyl, secondary alkyl, and aryl type), di-phenyl sulfide, methyl tri-chlorostearate, chlorinated naphthalene, fluoroalkylpolysiloxane, lead naphthenate, neutralized or partially neutralized phosphates, di-thiophosphates, and sulfur-free phosphates.

As described herein, the multigrade engine oil comprises a pour point depressant. The multigrade engine oil can also include one or more base oil additives in addition to the pour point depressant. As such, the multigrade engine oil can include a pour point depressant and one or more additives selected from the group consisting of anti-wear additives, extreme pressure agents, detergents (e.g., metal-containing detergents), dispersants (e.g., ashless dispersants), antioxidants, viscosity index improvers, viscosity modifiers, friction modifiers, demulsifiers, antifoaming agents, inhibitors (e.g., corrosion inhibitors), seal swell agents, emulsifiers, wetting agents, lubricity improvers, metal deactivators, gelling agents, tackiness agents, bactericides, fluid-loss additives, and colorants. The additional additives can be added in the form of an additive package, containing various additives. One of ordinary skill in the art can readily select base oil additives, including appropriate amounts.

Process for Preparing the Multigrade Engine Oil

The multigrade engine oil as described herein is prepared by a process comprising (a) providing a first base oil in a major amount wherein the first base oil has a MRV viscosity at a test temperature from −25° C. to −40° C. of greater than 60,000 cP and a MRV yield stress at the test temperature of greater than zero; (b) providing a second base oil having a MRV viscosity at the test temperature of 60,000 cP or less and no MRV yield stress at the test temperature; (c) providing a pour point depressant; and (d) blending the first base oil, the second base oil, and the pour point depressant to provide the multigrade engine oil, wherein the multigrade engine oil has a MRV viscosity at the test temperature of 60,000 cP or less and no MRV yield stress at the test temperature. Blending and addition techniques are well known to those of ordinary skill in the art.

The multigrade engine oil includes the first lubricating base oil in a major amount. Since the first lubricating base oil is present in a major amount, the first lubricating base oil is present in an amount greater than any other component of the multigrade engine oil, including the amount of the second lubricating base oil. The multigrade engine oil prepared by this process exhibits excellent low temperature viscometric properties, including a MRV viscosity at the test temperature of 60,000 cP or less and no MRV yield stress at the test temperature.

In one embodiment, the test temperature is about −25° C. In this embodiment, the multigrade engine oil meets SAE viscosity grade 15W. In another embodiment, the test temperature is about −30° C. In this embodiment, the multigrade engine oil meets SAE viscosity grade 10W. In yet another embodiment, the test temperature is about −35° C. In this embodiment, the multigrade engine oil meets SAE viscosity grade 5W. Alternatively, the test temperature is about −40° C. In this embodiment, the multigrade engine oil meets SAE viscosity grade 0W.

The multigrade engine oil can also contain one or more base oil additives in addition to the pour point depressant. In these embodiments, the process for preparing the multigrade engine oil further involves blending the one or more base oil additives in addition to the pour point depressant with the first base oil, the second base oil, and the pour point depressant to provide the multigrade engine oil. The amounts for providing and blending the various components of the multigrade engine oil are as described herein.

The components of the multigrade engine oil can be blended in any order. For example, it may be desirable to prepare an additive package including the pour point depressant and the one or more base oil additives in addition to the pour point depressant prior to blending the pour point depressant and the one or more other base oil additives with the first base oil and the second base oil. The lubricating base oils may be blended together prior to blending with the pour point depressant and optional one or more additives in addition to the pour point depressant.

EXAMPLES

The following examples are provided to demonstrate particular embodiments of the multigrade engine oil disclosed herein. The following examples utilize the following base oils: Motiva™ Star 6, Petrobras™ Paraffinic Light Neutral 30, Petrobras™ Paraffinic Spindle 09, and Chevron™ 220R.

Motiva™ Star 6 refers to a base oil with the properties of Table 1. Motiva™ Star 6 is a Group II base oil.

Petrobras™ Paraffinic Light Neutral 30 refers to a base oil with the properties of Table 2. Petrobras™ Paraffinic Light Neutral 30 is a Group I base oil.

Petrobras™ Paraffinic Spindle 09 refers to a base oil with the properties of Table 3. Petrobras™ Paraffinic Spindle 09 is a Group I base oil.

Chevron™ 220R refers to a base oil with the properties of Table 4. Chevron™ 220R is a Group II base oil.

Chevron™ 220R and Motiva™ Star 6 both meet MRV viscosity and yield stress specifications at −30° C. Petrobras™ Paraffinic Light Neutral 30 and Petrobras™ Paraffinic Spindle 09 do not meet MRV viscosity and yield stress specifications at −30° C.

TABLE 1

Motiva ™ Star 6

| Specification Test | Parameter | Unit of Measure | Test Method | Min | Max | Typical |
|---|---|---|---|---|---|---|
| Appearance | | | OBSERVATION | Clear & Bright | | |
| Infrared Scan | | | ASTM E1252 | Conform to Standard | | |
| API Gravity | | ° API | ASTM D287 | Report | | 31.5 |
| Flash Point, COC | | ° C. | ASTM D92 | 216 | | 225 |
| Kinematic Viscosity | 40° C. | $mm^2/s$ | ASTM D445 | 40.0 | 46.0 | 42.1 |
| Kinematic Viscosity | 100° C. | $mm^2/s$ | ASTM D445 | 6.1 | | 6.39 |
| Apparent Viscosity, CCS | −20° C. | mPa · s | ASTM D5293 | | 3900 | 3200 |
| Viscosity Index | | | ASTM D2270 | 95 | | 100 |
| Sulfur | | mass % | X-ray/ICP | | 0.03 | 0.0015 |
| ASTM Color | | | ASTM D1500 | | 1.0 | 0.5 |
| Pour Point | | ° C. | ASTM D97 | | −12 | −15 |
| HPLC Analysis | | | | | | |
| Aromatics | | mass % | HPLC | | 2.0 | 1.5 |
| Boiling Range Distribution, GC | | | ASTM D2887 | | | |
| Percent Recovered | 700° F. | mass % | ASTM D2887 | | 7.0 | 6.0 |
| Noack Evaporation Loss, Proc B | 1 h, 250° C. | mass % | ASTM D5800 | Report | 13 | 11 |
| Relative Density | 15.6/15.6° C. | | ASTM D1298 | | | 0.8681 |
| Density | 60° F. | lb/gal | ASTM D1298 | | | 7.228 |
| Density | 15° C. | kg/L | ASTM D1298 | | | 0.8676 |

TABLE 2

Petrobras ™ Paraffinic Light Neutral 30

| Specification Test | Parameter | Unit of Measure | Test Method | Min | Max | Typical |
|---|---|---|---|---|---|---|
| Aniline Point | | ° C. | ASTM D611 | | | 99.8 |
| Ash | | mass % | ASTM D482 | | 0.005 | |
| Carbon Distribution | | | ASTM D3238 | | | |
| Aromatic Carbon | | mass % | ASTM D3238 | | | 6.0 |
| Naphthenic Carbon | | mass % | ASTM D3238 | | | 31.0 |
| Paraffinic Carbon | | mass % | ASTM D3238 | | | 63.0 |
| Copper Corrosion | 3 h, 100° C. | | ASTM D130 | | 1B | |
| Carbon-Type Composition | | | ASTM D2140 | | | |
| Refractivity Intercept | | | ASTM D2140 | | | 1.0451 |
| Flash Point, COC | | ° C. | ASTM D92 | 200 | | 218 |
| Infrared Scan | | | ASTM E1252 | Conform to Standard | | |
| Pour Point | | ° C. | ASTM D97 | | −6 | −9 |
| Micro Method Carbon Residue | | mass % | ASTM D4530 | | 0.10 | |
| Refractive Index | 20° C. | | ASTM D1218 | | | 1.478 |
| Sulfur | | mass % | ASTM D1552 | REPORT | | |
| Viscosity-Gravity Constant | | | ASTM D2501 | | | 0.828 |
| Water by Distillation | | volume % | ASTM D95 | ABSENT | | |
| Acid Number | | mg KOH/g | ASTM D974 | 0.05 | 0.01 | |
| Appearance | | | OBSERVATION | CLEAR | | |
| ASTM Color | | | ASTM D1500 | | 1.5 | |
| Density | 20° C. | kg/L | ASTM D1298 | | | 0.866 |
| Kinematic Viscosity | 40° C. | $mm^2/s$ | ASTM D445 | 27.0 | 31.0 | 28.2 |

TABLE 2-continued

| Petrobras ™ Paraffinic Light Neutral 30 | | | | | | |
|---|---|---|---|---|---|---|
| Specification Test | Parameter | Unit of Measure | Test Method | Min | Max | Typical |
| Kinematic Viscosity | 100° C. | $mm^2/s$ | ASTM D445 | | | 5.00 |
| Viscosity Index | | | ASTM D2270 | 100 | | 102 |

TABLE 3

| Petrobras ™ Paraffinic Spindle 09 | | | | | | |
|---|---|---|---|---|---|---|
| Specification Test | Parameter | Unit of Measure | Test Method | Min | Max | Typical |
| Aniline Point | | ° C. | ASTM D611 | | | 89.0 |
| Ash | | mass % | ASTM D482 | | 0.005 | 0.01 |
| Carbon Distribution | | | ASTM D3238 | | | |
| Aromatic Carbon | | mass % | ASTM D3238 | | | 5 |
| Naphthenic Carbon | | mass % | ASTM D3238 | | | 27 |
| Paraffinic Carbon | | mass % | ASTM D3238 | | | 68 |
| Carbon-Type Composition | | | ASTM D2140 | | | |
| Refractivity Intercept | | | ASTM D2140 | | | 1.046 |
| Infrared Scan | | | ASTM E1252 | Conform to Standard | | |
| Micro Method Carbon Residue | | mass % | ASTM D4530 | | 0.1 | 0.04 |
| Refractive Index | 20° C. | | ASTM D1218 | | | 1.470 |
| Sulfur | | mass % | ASTM D1552 | | | 0.23 |
| Viscosity-Gravity Constant | | | ASTM D2501 | | | 0.818 |
| Water by Distillation | | volume % | ASTM D95 | ABSENT | | |
| Acid Number | | mg KOH/g | ASTM D974 | | 0.05 | 0.05 |
| Appearance | | | OBSERVATION | CLEAR | | |
| ASTM Color | | | ASTM D1500 | | 1.0 | |
| Copper Corrosion | 3 h, 100° C. | | ASTM D130 | | 1B | |
| Density | 20° C. | kg/L | ASTM D1298 | | | 0.848 |
| Flash Point, COC | | ° C. | ASTM D92 | 160 | | 162 |
| Pour Point | | ° C. | ASTM D97 | | −3 | |
| Kinematic Viscosity | 40° C. | $mm^2/s$ | ASTM D445 | 8.3 | 10.9 | 9.8 |
| Kinematic Viscosity | 100° C. | $mm^2/s$ | ASTM D445 | | | 2.60 |
| Viscosity Index | | | ASTM D2270 | 90 | | 93 |

TABLE 4

| Chevron ™ 220R | | | | | | |
|---|---|---|---|---|---|---|
| Specification Test | Parameter | Unit of Measure | Test Method | Min | Max | Typical |
| Appearance, Odor and Texture | | | OBSERVATION | | | |
| Appearance | | | OBSERVATION | Clear & Bright | | |
| API Gravity | | ° API | ASTM D287 | | | 31.9 |
| Density | 15° C. | kg/L | ASTM D1298 | | | 0.8655 |
| Flash Point, COC | | ° C. | ASTM D92 | 212 | | 230 |
| Kinematic Viscosity | 40° C. | $mm^2/s$ | ASTM D445 | 40.00 | 46.00 | 43.7 |
| Kinematic Viscosity | 100° C. | $mm^2/s$ | ASTM D445 | Report | | 6.60 |
| Apparent Viscosity, CCS | −20° C. | cP | ASTM D5293 | | 3600 | 3400 |
| Viscosity Index | | | ASTM D2270 | 95 | | 102 |
| Sulfur | | mg/kg | ASTM D7039 | | | <10 |
| ASTM Color | | | ASTM D1500 | | 1.5 | L0.5 |
| Pour Point | | ° C. | ASTM D97 | | −12 | −13 |
| Water Content | | mg/kg | ASTM D6304 | Report | | |
| Noack Evaporation Loss, Proc B | 1 h, 250° C. | mass % | ASTM D5800 | | 12 | 10 |
| Density | 60° F. | lb/gal | ASTM D1298 | Report | | 7.216 |

Example 1

In the first round of testing, the original formulation was tested for kinematic viscosity at 100° C. (KV100) (ASTM D445), kinematic viscosity at 40° C. (KV40) (ASTM D445), viscosity index (ASTM D2270), cold cranking simulator (CCS) viscosity at −25° C. (ASTM D5293), pour point (ASTM D97), and MRV viscosity and yield stress at −30° C. (ASTM D4684). Additional formulations were tested with modifications in only the amount of pour point depressant (PPD). Table 5 shows the formulations and test results.

TABLE 5

| Components/ Test Results | Original Formulation | Modified Formulation 1 | Modified Formulation 2 | Modified Formulation 3 | Modified Formulation 4 | Modified Formulation 5 |
|---|---|---|---|---|---|---|
| Paraffinic Light Neutral (wt %) | 73.436 | 73.586 | 73.386 | 73.336 | 73.286 | 73.236 |
| Paraffinic Spindle Oil (wt %) | 8.786 | 8.936 | 8.736 | 8.686 | 8.636 | 8.586 |
| Detergent/ Dispersant Package (wt %) | 10 | 10 | 10 | 10 | 10 | 10 |
| Viscosity Modifier (wt %) | 6.028 | 6.028 | 6.028 | 6.028 | 6.028 | 6.028 |
| Friction Reducing Compound (wt %) | 1.435 | 1.435 | 1.435 | 1.435 | 1.435 | 1.435 |
| Demulsifier (wt %) | 0.005 | 0.005 | 0.005 | 0.005 | 0.005 | 0.005 |
| Foam Inhibitor (wt %) | 0.01 | 0.01 | 0.01 | 0.01 | 0.01 | 0.01 |
| PPD (wt %) | 0.3 | 0 | 0.4 | 0.5 | 0.6 | 0.7 |
| KV 100 (cSt) | 9.95 | 9.8 | 10 | 10.06 | 10.07 | 10.17 |
| KV 40 (cSt) | 61.93 | 60.8 | 62.6 | 62.68 | 63.14 | 63.09 |
| VI | 146 | 146 | 145 | 147 | 145 | 146 |
| CCS (cP) | 6440 | 6056 | 6474 | 6561 | 6597 | 6689 |
| Pour Point (° C.) | −36 | −9 | −36 | −36 | −39 | −36 |
| MRV Vis at −30° C. (cP) | 66101 | 5292994 | 64713 | 64849 | 69950 | 66555 |
| MRV Yield Stress at −30° C. (Pa) | 70 | >350 | 70 | 70 | 70 | 70 |

As demonstrated, adding pour point depressant (PPD) does not achieve a formulation having a MRV viscosity at the test temperature of 60,000 cP or less and no MRV yield stress at the test temperature of −30° C.

Example 2

In the second set of testing, the original formulation was tested again for Scanning Brookfield viscosity (ASTM D5133), MRV viscosity and yield stress (ASTM D4684), and the pour point (ASTM D97).

Two additional formulations were tested with the base oil ratios adjusted to contain 20% Group II oils. A fourth formulation was created with 20 wt % Group II oils and no pour point depressant (PPD), as shown below in Table 6.

TABLE 6

| Component Name | ENG09348 | ENG09363 | ENG09364 | ENG09418 |
|---|---|---|---|---|
| Chevron ™ 220R (wt %) | 0 | 20 | 0 | 20 |
| Motiva ™ Star 6 (wt %) | 0 | 0 | 20 | 0 |
| (PETROBRAS ™) Paraffinic Light Neutral (wt %) | 73.4 | 49.2 | 49.2 | 49.2 |
| (PETROBRAS ™) Paraffinic Spindle (wt %) | 8.8 | 13.0 | 13.0 | 13.0 |
| Detergent/ Dispersant (wt %) | 10 | 10 | 10 | 10 |
| Non-dispersant Viscosity Modifier (wt %) | 6.028 | 6.028 | 6.028 | 6.028 |
| Friction Reducing Compound (wt %) | 1.435 | 1.435 | 1.435 | 1.435 |
| Pour Point Depressant (wt %) | 0.3 | 0.3 | 0.3 | 0 |

TABLE 6-continued

| Component Name | ENG09348 | | ENG09363 | | ENG09364 | | ENG09418 |
|---|---|---|---|---|---|---|---|
| Demulsifier | 0.005 | | 0.005 | | 0.005 | | 0.005 |
| Foam inhibitor (wt %) | 0 | | 0 | | 0 | | 0 |
| Gelation Index | 11 | 10.7 | 8.3 | 7.1 | 7.3 | 6.9 | N/A |
| Gel Index Temp (° C.) | −6.9 | −6.9 | −6.9 | −7.4 | −8.1 | −10.8 | N/A |
| Scanning Brookfield Vis at −30° C. (cP) | 47,623 | 47,513 | 42,208 | 42,243 | 47,374 | 43,330 | N/A |
| MRV Yield Stress at −30° C. (Pa) | 105 | 315 | NYS | NYS | NYS | NYS | 315 |
| MRV Vis at −30° C. (cP) | 51,838 | 53,372 | 40,089 | 39,790 | 40,344 | 47,876 | >60,000 |
| Pour Point, (° C.) | −38 | −41 | −43 | −42 | −44 | −43 | −11 |

NYS is defined as "no yield stress".
N/A is defined as "not available".

The results in Table 5 show the cold flow properties for the formulations containing Petrobras™ Paraffinic Light Neutral 30 and Petrobras™ Paraffinic Spindle 09 with pour point depressant were better than the formulation containing Petrobras™ Paraffinic Light Neutral 30 and Petrobras™ Paraffinic Spindle 09 without pour point depressant. In particular, the pour point, the MRV viscosity, and the MRV yield stress for the formulations with pour point depressant were lower than the formulation without pour point depressant. However, the formulations with pour point depressant did not meet SAE J300 MRV viscosity at −30° C., even as the amount of pour point depressant increased, because the MRV viscosity values for these formulations at −30° C. were greater than 60,000 cP. Furthermore, the formulations with pour point depressant still exhibited MRV yield stress at −30° C., even as the amount of pour point depressant increased.

The results in Table 6 show the cold flow properties for formulations with Chevron™ 220R or Motiva™ Star 6 were better than the original formulation with Petrobras™ Paraffinic Light Neutral 30 and Petrobras™ Paraffinic Spindle 09 only. Addition of Chevron™ 220R or Motiva™ Star 6 to the original formulation eliminated the yield stress without the need for additional PPD. Although addition of Chevron™ 220R or Motiva™ Star 6 did not eliminate the need for some PPD, addition of Chevron™ 220R or Motiva™ Star 6 to a formulation with some PPD proved to be a robust solution for eliminating MRV yield stress. Also, addition of Chevron™ 220R or Motiva™ Star 6 lowered the MRV viscosity at −30° C. and slightly lowered the pour point.

These results demonstrate that adding a base oil meeting MRV specifications to a major amount of a base oil not meeting MRV specifications, with some minor amount of PPD, provides a blend meeting MRV specifications.

There are a few possible reasons for the demonstrated improvement in MRV yield stress and viscosity. For example, Chevron™ 220R or Motiva™ Star 6 may break up the wax structure or may cause the formation of additional wax structures that interfere with the existing wax structures. Alternatively, the PPD could be more compatible in the combined base oils.

What is claimed is:

1. A multigrade engine oil comprising:

a) a major amount of a first lubricating base oil having a first MRV viscosity at a test temperature from −25° C. to −40° C. of greater than 60,000 cP and a first MRV yield stress at the test temperature of greater than zero, wherein the first lubricating base oil is a Group I base oil;

b) a minor amount of a second lubricating base oil having a second MRV viscosity at the test temperature of 60,000 cP or less and no second MRV yield stress at the test temperature, wherein the second lubricating base oil is a Group II base oil; and c) a pour point depressant, wherein the multigrade engine oil has a MRV viscosity at the test temperature of 60,000 cP or less and no MRV yield stress at the test temperature.

2. The multigrade engine oil of claim 1, further comprising one or more base oil additives in addition to the pour point depressant.

3. The multigrade engine oil of claim 1, wherein the test temperature is −30° C.

4. The multigrade engine oil of claim 3, wherein the multigrade engine oil has the MRV viscosity at −30° C. of 50,000 cP or less.

5. The multigrade engine oil of claim 1, wherein the multigrade engine oil comprises:

the first lubricating base oil in an amount of from about 40 wt % to about 90 wt %;

the second lubricating base oil in an amount of from about 5 wt % to about 35 wt %; and the pour point depressant in an amount of from about 0.1 wt % to about 2 wt %.

6. The multigrade engine oil of claim 5, wherein the multigrade engine oil comprises the pour point depressant in an amount of about 0.1 wt % to about 0.5 wt %.

7. The multigrade engine oil of claim 1, wherein the multigrade engine oil comprises the first lubricating base oil in an amount of from about 40 wt % to about 95 wt % and the second lubricating base oil in an amount of from about 5 wt % to about 35 wt %.

8. The multigrade engine oil of claim 1, wherein the multigrade engine oil comprises the first lubricating base oil in an amount of from about 40 wt % to about 80 wt %; the second lubricating base oil in an amount of from about 10 wt % to about 30 wt %; the pour point depressant in an amount of from about 0.1 wt % to about 1.0 wt %; and one or more base oil additives in addition to the pour point depressant.

9. The multigrade engine oil of claim 1, wherein the multigrade engine oil is a SAE viscosity grade 0W-X, 5W-X, or 10W-X engine oil, wherein X represents an integer selected from the group consisting of 20, 30, and 40.

10. A process for preparing a multigrade engine oil, comprising:

a) providing in a major amount a first lubricating base oil having a first MRV viscosity at a test temperature from −25° C. to −40° C. of greater than 60,000 cP and a first MRV yield stress at the test temperature of greater than zero, wherein the first lubricating base oil is a Group I base oil;

b) providing in a minor amount a second lubricating base oil having a second MRV viscosity at the test temperature of 60,000 cP or less and no second MRV yield stress at the test temperature, wherein the second lubricating base oil is a Group II base oil;

c) providing a pour point depressant; and d) blending the first lubricating base oil, the second lubricating base oil, and the pour point depressant to provide the multigrade engine oil, wherein the multigrade engine oil has a MRV viscosity at the test temperature of 60,000 cP or less and no MRV yield stress at the test temperature.

11. The process for preparing the multigrade engine oil of claim 10, wherein the test temperature is −30° C.

12. The process for preparing the multigrade engine oil of claim 11, wherein the multigrade engine oil has the MRV viscosity at −30° C. of 50,000 cP or less.

13. The process for preparing the multigrade engine oil of claim 10, further comprising:

providing one or more base oil additives in addition to the pour point depressant; and blending the one or more base oil additives with the first lubricating base oil, the second lubricating base oil, and the pour point depressant to provide the multigrade engine oil.

14. The process for preparing the multigrade engine oil of claim 10, wherein the multigrade engine oil after blending comprises: the first lubricating base oil in an amount of from about 40 wt % to about 80 wt %; the second lubricating base oil in an amount of from about 10 wt % to about 30 wt %; and the pour point depressant in an amount of from about 0.1 wt % to about 1 wt %.

15. The process for preparing the multigrade engine oil of claim 10, wherein the multigrade engine oil is a SAE viscosity grade 0W-X, 5W-X, or 10W-X engine oil, wherein X represents an integer selected from the group consisting of 20, 30, and 40.

* * * * *